United States Patent [19]

Honnorat et al.

[11] Patent Number: 4,725,497

[45] Date of Patent: Feb. 16, 1988

[54] UNFALSIFIABLE SAFETY PAPER

[75] Inventors: André Honnorat, Annecy le Vieux; Claude Riou, Veyrier le Lac; Louis Raux, Cran Gevrier, all of France

[73] Assignee: Societe Anonyme: Aussedat-Rey, France

[21] Appl. No.: 820,436

[22] Filed: Jan. 17, 1986

[30] Foreign Application Priority Data

Jan. 21, 1985 [FR] France ..... 85 00939

[51] Int. Cl.[4] ..... B32B 23/04; D21H 5/10

[52] U.S. Cl. ..... 428/340; 428/323; 428/537.5; 428/915; 162/140; 162/162

[58] Field of Search ..... 428/323, 915, 537.5, 428/340

[56] References Cited

U.S. PATENT DOCUMENTS

| | | | |
|---|---|---|---|
| 2,333,979 | 11/1943 | Bradt | 428/915 |
| 4,322,466 | 3/1982 | Tomlinson | 428/915 |
| 4,451,521 | 5/1984 | Kaule et al. | 428/323 |

FOREIGN PATENT DOCUMENTS

| | | | |
|---|---|---|---|
| 1435686 | 5/1976 | United Kingdom | 428/915 |

*Primary Examiner*—P. C. Ives

*Attorney, Agent, or Firm*—Lerner, David, Littenberg, Krumholz & Mentlik

[57] ABSTRACT

This invention relates to an unfalsifiable safety paper comprising on its surface and/or in its mass, at least one compound responding to formula:

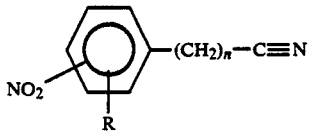

(I)

in which:

R corresponds to hydrogen, to an alkyl group of $C_1$ to $C_8$, substituted or not, to a non-substituted, N-substituted or N,N-substituted amine group, to $NO_2$, to a halogen;

n is equal to 0 or 1.

The invention is applicable to handwritten pieces for payment.

20 Claims, No Drawings

UNFALSIFIABLE SAFETY PAPER

FIELD OF THE INVENTION

The present invention relates to the field of paper manufacture. More particularly, the present invention relates to a novel unfalsifiable safety paper, a process for rendering a paper unfalsifiable, and an aqueous or organic composition which can be used in particular to render a paper unfalsifiable.

BACKGROUND OF THE INVENTION

So-called "safety" papers, which can be used in particular for manufacturing handwritten payment documents and official documents such as checks, travelers' checks, etc., must be protected from any attempts to falsify the writing or stamps carried on the papers, using any kind of chemical reagent or modern process, such as an ink-erasing pencil. The colored inks currently employed for writing by hand or printing by means of inking pads can be cleanly removed using these erasing pencils.

However, the majority of safety papers currently available on the market react inadequately to such attempts at falsification with ink-erasing pencils. This often causes the appearance of a fluorescent yellow color which is not easily visible to the naked eye and which furthermore cna prove troublesome for certain uses.

Thus, French Pat. No. 2,365,656 describes a safety paper containing a chemical sensitizing composition based on an acid-base indicator which is very sensitive to pH variations. The indicator is selected especially from the group comprising the phthaleins or sulfophthaleins. When the pH rises (due to the action of the erasing pencil), the paper develops a coloration. However, all the products described therein are difficult to use in paper manufacture, mainly because of the conditions governing their solubilization, use pH, reversibility or stability.

French Pat. No. 2,399,505, and its Certificate of Addition No. 2,402,739 describe a safety paper containing a chemical sensitizing composition based on an oxypyrenetricarboxylic acid salt called Pyranine. The action of an erasing pencil on such papers develops a fluorescent yellow coloration.

French Pat. No. 2,406,027, and French Pat. No. 2,427,436, as well as its Certificate of Addition No. 2,432,576, describe a safety paper containing dinitrophenols which turn a non-fluorescent yellow under the action of an erasing pencil.

Finally, French Pat. No. 2,410,702 describes a safety paper containing a chemical sensitizing composition composed of Pyranine in association with an optical brightener along with a variety of other compounds. The action of an erasing felt pen on a paper of this kind produces a fluorescent yellow coloration.

The object of this invention is to propose a compound which, when associated with a paper, renders it unfalsifiable even by erasing pencils, by instantaneously developing a coloration which can be clearly detected by the naked eye.

SUMMARY OF THE INVENTION

The paper according to the invention contains, on its surface, and/or in its bulk, at least one compound corresponding to the formula:

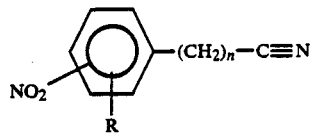

(I)

in which the substituents R and/or $NO_2$ can be in the ortho, meta or para position relative to $(CH_2)_n$—CN. In the above formula, R corresponds to hydrogen, a substituted or unsubstituted $C_1$ to $C_8$ alkyl group, an unsubstituted, N-substituted or N,N-substituted amine group, $NO_2$ or a halogen, and n equals 0 or 1.

The invention also relates to a process for rendering a paper unfalsifiable, which comprises associating at least one compound of the formula I therewith.

DETAILED DESCRIPTION

The paper of this invention can have any kind of fibrous constitution, i.e. purely cellulosic or partly synthetic, to which the adjuvants conventionally used in paper manufacture can be added, namely mineral fillers, various agents for imparting color fastness, binders, resins, shading dyes, neutral, acidic or basic sizes, aluminum sulfate for acid sizing or pH adjustment, etc.

Numerous compounds are suitable for carrying out the present invention. Among these compounds, preference will be given to those corresponding to the following two substructures (1) and (2):

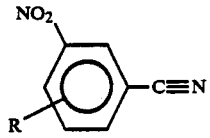

(1)

in which the substituent R can be in the ortho, meta or para position relative to CN, and in which R can be H, substituted or unsubstituted alkyl, $NH_2$, NHR', NR'R" (it being possible for R' and R" to be a variety of aryl groups, especially those substituted by CN and/or $NO_2$ groups, or alkyl groups), the halogens or $NO_2$.

Examples of these preferred compounds are:

metabenzonitrile

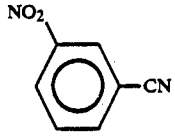

2-amino-5-nitrobenzonitrile

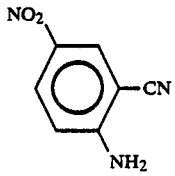

3,5-dinitrobenzonitrile

-continued

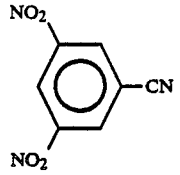

2-chloro-5-nitrobenzonitrile

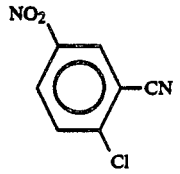

and

N,N—di(2-cyano-4-nitrophenyl)amine

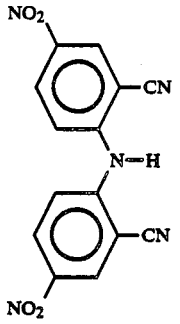

(2)

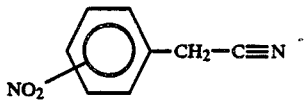

in which $NO_2$ can be in the ortho, meta or para position relative to $CH_2CN$.

Examples of these compounds are:

orthonitrophenylacetonitrile

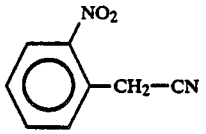

and paranitrophenylacetonitrile

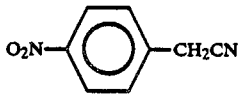

Furthermore, the paper will preferably contain at least 0.0001 g/m$^2$ of the compound, and advantageously between 0.01 and 0.15 g/m$^2$.

The paper can also contain sensitizing reagents analogous to those already used at the present time in safety papers, for example products which ensure that the paper changes appearance when it comes into contact with acids or oxidizing agents. As is known, these products are introduced either in the form of an aqueous solution, in which case it is necessary to ensure that they are retained on the fibers by direct bonding or via fixing agents, or in the form of a microdispersed or pigmentary precipitate.

Thus, the couple ferric chloride/manganese ferrocyanide reacts to attempts at falsification by means of acids, oxidizing agents and erasing products which give an acid reaction (of the "corector" type).

There is no problem of compatibility between the sensitizers and the products of the structure (I), provided these sensitizers are neither bases nor reducing agents. In fact, as the main property of the products (I), which forms the subject of this application, is to develop a coloration in the presence of bases or reducing agents (the main components of ink-erasing felt pens), the association of a product (I) with a basic or reducing product would produce a colored paper which was inert to attempted falsification by a base, reducing agent or erasing felt pen.

In their bulk, these papers can also contain, dispersed and in the pigmentary form, one or more dyes which are insoluble in water but soluble in organic solvents, so as to protect the writing or particulars carried on these papers from attempts at falsification by means of organic solvents. Moreover, these papers can be watermarked or can contain various artificial means for ensuring their recognition, such as colored and/or fluorescent particles, chips or fibers.

A first process for rendering an unfalsifiable paper consists in incorporating the compound of formula (I) into the paper when it is being manufactured.

A second process consists in depositing an aqueous composition containing a compound of the formula (I) as defined above, and a coating binder, onto one or both sides of a sheet of paper.

Synthetic or natural polymers with compatible hydroxyl end groups, such as starch, polyvinyl alcohol and cellulose derivatives, may be mentioned by way of indication among the coating binders.

It has been found to be particularly advantageous to include a synthetic surfactant in the composition in order to improve its solubility and reactivity.

A large number of surfactants are known, but it is not the purpose of this description to provide an exhaustive list thereof.

Briefly, the surfactants can be divided into three general categories. These include (A) the anionic detergents (excluding true soaps). Among these, there may be mentioned alkylsulfates such as laurylsulfate, alkylbenzenesulfonates and sulfonated olefins. Also, (B) the neutral or non-ionic detergents are included, among which may be mentioned the detergents known commercially under the tradmarks "PLURONIC" or "DISPONIL." These compounds can be obtained by condensing ethylene oxide with an alcohol which has a hydrophobic residue, for example polyethylene oxide/alkylphenol condensation products. Finally, (C) the cationic detergents are noted. This group of detergents can be defined as comprising derivatives of quaternary aliphatic ammonium, phosphonium and sulfonium compounds in which the aliphatic radicals can have a linear or branched chain and in which one of the aliphatic substitutents contains about 8 to 18 carbon atoms.

A more complete description of those surfactants will be found in numerous documents, among which may be mentioned French Pat. Nos. 2,014,675 and 2,062,838.

The category of surfactant which is selected will depend on the structure of the compound corresponding to the formula (I) which is used. Thus, it will be advantageous to choose a surfactant from category (B) for the compounds of substructure (1) and a surfactant from group (C) (and, of these, the quaternary ammonium compounds) for the compounds of substructure (2).

Chlorine-based activators, such as Javel water, can optionally be added to this composition.

The composition preferably contains the following, in grams per liter of water,: from about 0.5 to 50 g of compound of the formula (I), by itself or in a mixture, from about 10 to 150 g of coating binder (depending on the binder used), from about 5 to 50 g of surfactant, and from about 1 to 100 g of the other adjuvants (activators etc.).

A third process consists in depositing a composition containing a compound of the formula (I), an organic solvent and a compatible coating binder onto one or both sides of a sheet of paper.

Solvents which may be mentioned in this regard are esters, ketones, alcohols, essential oils or aromatics. However, this process produces a paper which does not react to the action of the particular solvent which has been used in the process.

It should be specified that the term composition denotes not only solutions, i.e. compositions in which the constituents are in the form of solutes, but also partially solubilized or unsolubilized dispersions.

These compositions can be deposited by means of a coating technique used in paper manufacture (size press, roller systems, blade systems, etc.).

This invention also relates to the compositions per se. It can in any event be more fully appreciated with reference to the following examples:

EXAMPLE 1

A coating solution comprising the following, per liter of water:

1 g of paranitrohenylacetonitrile

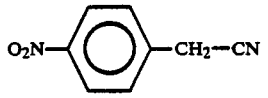

10 g of dodecylpyridinium chloride,
100 g of starch, and
0.5 g of activator (Javel water)

is deposited by a conventional papermaking technique (size press, roller systems) onto the surface of a paper substrate containing, in its bulk, reagents (a ferric salt and a precipitate of manganese ferrocyanide) and one or more dispersed dyes soluble in organic solvents, the purpose of these products being to make the paper sensitive to the acids and solvents which may be used to falsify the paper.

The coloration obtained with ink-erasing pencils and bases is violet-magenta.

On aging, the colorations produced with bases tend to turn green.

The paper treated in this way also reacts with Javel water to give a beige-brown coloration, and with acids and erasing products which give an acid reaction (of the "corector" type) to produce a blue coloration. Solvents color the paper differently according to their nature.

EXAMPLE 2

A coating solution comprising the following, per liter of water,:

10 g of orthonitrophenylacetonitrile

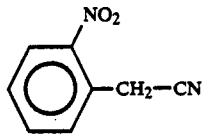

10 g of dodecylpyridinium chloride, and
20 g of the polyvinyl alcohol Rhodoviol 30-5 (R) (from Rhone-Poulenc)

is desposited by a conventional papermaking technique (size press, roller systems) onto the surface of a paper substrate containing, in its bulk, reagents (a ferric salt and a precipitate of manganese ferrocyanide) and one or more dispersed dyes soluble in organic solvents, the purpose of these products being to make the paper sensitive to the acids and solvents which may be used to falsify the paper.

The instantaneous coloration obtained with ink-erasing pencils, reducing agents and bases is pink. Acids and erasing products which give an acid reaction (of the "corector" type) lead to a blue coloration, Javel water to a brown coloration, and solvents to colorations which vary according to the solvent and dye introduced into the bulk.

EXAMPLE 3

A solution containing the following, per liter,:

4 g of 2-amino-5-nitrobenzonitrile (a Sandoz product)

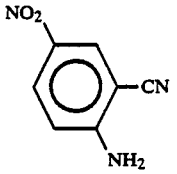

24 g of Disponil SML 120 (a product marketed by Hendel), and
20 g of the polyvinyl alcohol Rhodoviol 30-5 (from Rhone-Poulenc)

is deposited onto the surface of a paper simply containing a dye dispersed in the bulk. It is possible by doing so to obtain pink-magenta colorations with ink-erasing felt pens, bases and reducing agents, and with solvents, colorations which vary according to the solvent and dye used.

The reaction to acids, Javel water and erasing products which give an acid reaction (of the "corector" type) can be obtained by adding the usual known products to the coating solution or the bulk.

EXAMPLE 4

A coating solution containing the following:

3,5-dinitrobenzonitrile

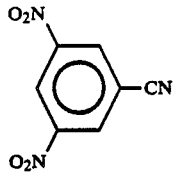

at a concentration of at least 0.5 g per liter,
hexadecylpyridinium chloride, for example, at a concentration of 12 g per liter, and
a coating binder, which can be starch or polyvinyl alcohols, is deposited onto the surface of a paper substrate identical to that in Example 1.

The reactions to attempts at falsification cause a reddish-pink coloration with reducing agents, bases and ink erasers, a blue coloration with acids and erasing products which give an acid reaction (of the "corector" type), a brown coloration with Javel water, and with solvents a coloration which varies according to the solvent used.

EXAMPLE 5

A coating solution containing the following:
5 g of 2-chloro-5-nitrobenzonitrile

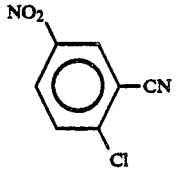

24 g of Disponil SML 120 (R) (a Henkel product), and
20 g of the polyvinyl alcohol Rhodoviol 30-5 (R) from Rhone-Poulenc is deposited onto the surface of a paper substrate containing the products mentioned above (a ferric salt, a precipitate of manganese ferrocyanide, a dye soluble in organic solvents), which can be incorporated into the bulk.

The paper treated in this way turns violet-magenta in the presence of bases, reducing agents or erasing felt pens and, as previously, blue with acids and erasing products which give an acid reaction (of the "corector" type), brown with Javel water, and with solvents a color which varies according to the solvent and dye used.

EXAMPLE 6

In the manufacture of a paper substrate, finely divided paranitrophenylacetonitrile:

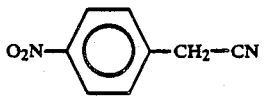

in association with hexadecylpyridinium chloride, is introduced into the bulk in addition to the reagents described above, such as a ferric salt, a precipitate of manganese ferrocyanide and one or more dispersed dyes soluble in organic solvents. The reactivity obtained after the sheet has been formed is identical to that described in Example 1 (a magenta coloration with erasing pencils, bases and reducing agents, a blue coloration with acids and erasing products which give an acid reaction (of the "corector" type), a brown coloration with Javel water and a variable coloration with solvents).

EXAMPLE 7

The following solution:
1 g of p-nitrophenylacetonitrile

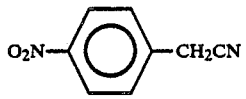

10 g of dodecylpyridinium chloride,
1000 g of ethyl acetate, and
50 g of Ixan SGA (R) (a polyvinylidene chloride marketed by Solvay).

is deposited by a conventional coating technique (engraved roller, roller systems, flexographic printing, etc.) onto the surface of a paper substrate containing, in its bulk, a ferric salt and manganese ferrocyanide but no dye soluble in organic solvents.

The reactions to attempts at falsifiction cause a pink coloration with reducing agents, a blue coloration with acids and erasing products which give an acid reaction (of the "corector" type), a purplish-blue coloration with bases and a brown coloration with Javel water. Erasing pencils form violet-magenta streaks which are stable with time.

EXAMPLE 8

A preparation comprising the following, per liter of water,:
0.05 g of N,N-di(2-cyano-4-nitrophenyl)amine

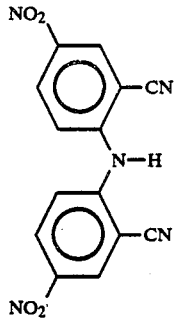

24 g of Disponil SML 102 (R) (a Henkel product), and
20 g of the polyvinyl alcohol Rhodoviol 30-5 (R) (a Rhone-Poulenc product)

is deposited by a conventional papermaking technique (size press, roller system, etc.) onto the surface of a paper substrate containing, in its bulk, reagents (a ferric salt and a precipitate of manganese ferrocyanide) and one or more dispersed dyes soluble in organic solvents.

The reactions to attempts at falsifiction cause a pink-magenta coloration with reducing agents, bases and erasing pencils, a blue coloration with acids and erasing products which give an acid reaction (of the "corector" type), a brown coloration with Javel water, and with solvents a coloration which varies according to the solvent used (and the dyes introduced into the bulk).

In all of the above examples, the paper is white and non-fluorescent after the surface-coating operations.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. An unfalsifiable safety paper including at least one compound having the formula:

(I)

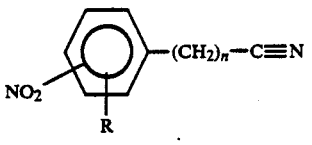

wherein R is selected from the group consisting of hydrogen, $C_1$ to $C_8$ alkyl, substituted $C_1$ to $C_8$ alkyl, amine, N-substituted amine, NN-substituted amine, $NO_2$, and halogens, and wherein N is 0 or 1.

2. The unfalsifiable safety paper of claim 1 wherein said compound I is provided on the surface of said safety paper.

3. The unfalsifiable safety paper of claim 1 wherein said compound I has the following structure:

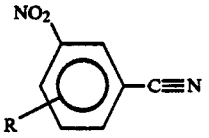

wherein R is selected from the group consisting of hydrogen, alkyl, substituted alkyl, $NH_2$, NHR', NR'R'', halogen, and $NO_2$, and wherein R' and R'' are selected from the group consisting of alkyl, aryl, and substituted aryl.

4. The unfalsifiable safety paper of claim 3 wherein said substituted aryl groups comprising R' and R'' comprise aryl groups substituted with a compound selected from the group consisting of CN and $NO_2$.

5. The unfalsifiable safety paper of claim 1 wherein said compound I has the formula:

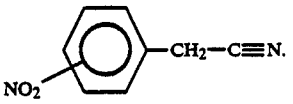

6. The unfalsifiable safety paper of claim 1 wherein said compound I has the formula:

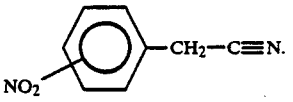

7. The unfalsifiable safety paper of claim 3 wherein said compound I is selected from the group consisting of:

metabenzonitrile

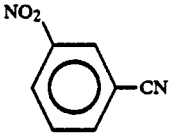

1-amino-5-nitrobenzonitrile

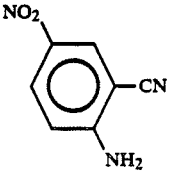

3,5-dinitrobenzonitrile

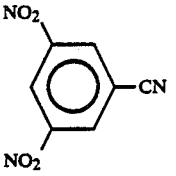

1-chloro-5-nitrobenzonitrile

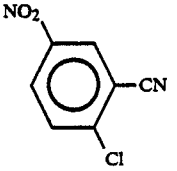

and

N,N—di(2-cyano-4-nitrophenyl)amine

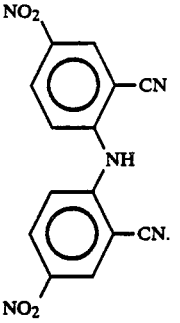

8. The unfalsifiable safety paper of claim 6 wherein said compound I is selected from the group consisting of:

orthonitrophenylacetonitrile

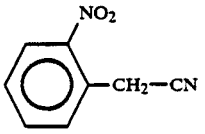

and

-continued paranitrophenylacetonitrile

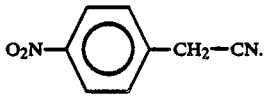

9. The unfalsifiable safety paper of claim 1 wherein said compound I is present in an amount of at least about 0.001 g/m$^2$.

10. The unfalsifiable safety paper of claim 1 comprising an aqueous composition including said compound I and a coating binder on at least one of the surfaces of said paper.

11. The unfalsifiable safety paper of claim 10 comprising said aqueous composition on both surfaces of said paper.

12. The unfalsifiable safety paper of claim 10 wherein said aqueous composition includes a surfactant.

13. The unfalsifiable safety paper of claim 12 wherein said aqueous composition comprises from about 0.5 to 50 grams per liter of said compound I.

14. The unfalsifiable safety paper of claim 13, wherein said aqueous composition further comprises from about 10 to about 150 grams per liter of said coating binder, and from about 5 to about 50 grams per liter of said surfactant.

15. The unfalsifiable safety paper of claim 14 wherein said aqueous composition further comprises an additional adjuvant.

16. The unfalsifiable safety paper of claim 14 wherein said compound I has the formula:

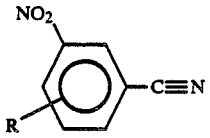

wherein R selects from the group consisting of hydrogen, alkyl, substituted alkyl, $NH_2$, NHR', NR'R'', halogen, and $NO_2$, wherein R' and R'' are selected from the group consisting of alkyl, aryl, and substituted aryl, and wherein said surfactant comprises a neutral surfactant.

17. The unfalsifiable safety paper of claim 14 wherein said compound I has the formula:

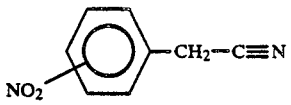

and wherein said surfactant comprises a cationic surfactant.

18. The unfalsifiable safety paper of claim 1 comprising an organic composition including said compound I on at least one surface of said paper.

19. The unfalsifiable safety paper of claim 18 wherein said organic composition includes a compatible coating binder.

20. The unfalsifiable safety paper of claim 19 comprising said organic composition on both sides of said paper.

* * * * *